United States Patent [19]

Neville

[11] Patent Number: 4,984,587

[45] Date of Patent: Jan. 15, 1991

[54] ROTARY CYLINDER DRYER AND METHOD OF DRYING TOBACCO PRODUCTS

[75] Inventor: Richard E. G. Neville, Salisbury, England

[73] Assignee: GBE International PLC, Andover, England

[21] Appl. No.: 435,370

[22] PCT Filed: Mar. 17, 1989

[86] PCT No.: PCT/GB89/00286

§ 371 Date: Nov. 13, 1989

§ 102(e) Date: Nov. 13, 1989

[87] PCT Pub. No.: WO89/08407

PCT Pub. Date: Sep. 21, 1989

[30] Foreign Application Priority Data

Mar. 19, 1988 [GB] United Kingdom ..... 8806597

[51] Int. Cl.[5] ..... A24B 3/04

[52] U.S. Cl. ..... 131/305; 131/302; 131/303; 34/92

[58] Field of Search ..... 131/290, 301, 305, 303, 131/311, 313, 322, 324; 34/92, 132

[56] References Cited

U.S. PATENT DOCUMENTS

| | | | |
|---|---|---|---|
| 3,906,961 | 9/1975 | Rowell et al. . | |
| 4,471,790 | 9/1984 | Davis et al. | 131/301 |
| 4,615,125 | 10/1986 | Wyborn | 34/92 |
| 4,898,189 | 2/1990 | Wochnowski | 131/300 |

FOREIGN PATENT DOCUMENTS

| | | |
|---|---|---|
| 3221602 | 1/1983 | Fed. Rep. of Germany . |
| 2447685 | 8/1980 | France . |
| 0502225 | 3/1939 | United Kingdom . |
| 932179 | 7/1963 | United Kingdom . |
| 2102549 | 2/1983 | United Kingdom . |

*Primary Examiner*—V. Millin

*Attorney, Agent, or Firm*—James C. Wray

[57] ABSTRACT

The invention provides a rotary dryer for tobacco products comprising a cylinder arranged for rotation about an inclined axis and having means for feeding tobacco into one end of the drying cylinder and means for conveying dried tobacco from the other end of the drying cylinder, heating means arranged to heat the cylinder, a housing arranged to contain the drying cylinder and sealed to be substantially airtight, means for reducing pressure in the drying cylinder below atmospheric pressure; and preferably but not essentially, means for superheating steam, means for injecting steam adjacent the superheating means, for conveying steam leaving the injection means at one end of the cylinder to the superheating means, and ducting for conveying superheated steam for said superheating means to the other end of said cylinder. The invention further provides a method of drying tobacco products comprising subjecting the tobacco to an atmosphere of superheated steam in a rotary drying chamber, while said atmosphere is maintained at a pressure below atmospheric pressure.

14 Claims, 2 Drawing Sheets

ROTARY CYLINDER DRYER AND METHOD OF DRYING TOBACCO PRODUCTS

BACKGROUND OF THE INVENTION

1. Field of the Invention

This invention relates to a rotary cylinder dryer for drying tobacco under high humidity conditions and in particular relates to a tobacco drying process in which due regard is given to the gain of filling power which is achieved when the tobacco is dried in a steam atmosphere.

The dryer of the present invention is intended for use with all forms of tobacco leaf but more particularly for the separated midrib in the finely cut or rolled and cut form. The latter is known as cut rolled stem (C.R.S.).

2. Statement of Prior Art

A rotary cylinder dryer of the single cylinder type is described in our UK Patent No. 1,209,929 and the double cylinder type (annular dryer) is described in our UK Patent No. 1,345,373. The cylinder of both these types are heated by steam or high pressure hot water. Rotary cylinder dryers are also known which are heated by other means such as a direct flame or a hot gas.

These dryers are of the type where the heated cylindrical shell provides the majority of the heat for drying by conduction or radiation from the shell to the tobacco and the ventilation air through the cylinder removes the moisture. The air flow is limited from 0.3 to 0.6 m/s to avoid making the tobacco airborne and so the air can only contribute a minority of the drying heat, but very often provides none.

Filling power is the specific volume or inverse of bulk density measured under defined conditions. Typically a 50 g sample, which has been brought to a standard moisture content and temperature, is placed in a 60 mm dia vertical cylinder and subjected to a free falling piston load of 3 kg for 30 seconds before measuring the height of the tobacco and calculating the filling power.

The filling power is usually expressed as cc/gm or ml/g. The filling power gain of a process is the percentage increase in the filling value from before to after the process.

It has been established that drying tobacco in a high humidity atmosphere results in a filling power gain. This has been shown for air duct type dryers such as described in UK Patent application No. 2004999A in which the heat for drying is entirely supplied by the air which carries off the vapor. The circulating air has a wet bulb temperature of at least 65 degrees C. and a dry bulb temperature up to 343 degrees C.

The humidity may be further increased until the wet bulb is 100 degrees C. i.e. the saturation temperature for steam at atmospheric pressure, as described in UK Patent application No. 2 149 897A, in which case dry bulb temperatures of 343 degrees C. to 510 degrees C. are used, i.e. the steam is superheated to provide the heat for drying the tobacco.

Similarly it is established practice to raise the humidity of the ventilating air in a rotary dryer in order to increase the filling power of the tobacco, but this has up to now been confined to modest increases in humidity and the retention of air as a ventilating means.

For tobacco to dry, the vapor pressure at the surface of the tobacco must exceed the vapor pressure in the surrounding atmosphere. If the water in the tobacco was 'free' water then the water on the tobacco would start to evaporate when its temperature equalled the saturation temperature of the surrounding atmosphere which is related to the humidity. In fact tobacco is hygroscopic and most of the water is 'bound' water so evaporation does not start until the tobacco exceeds the saturation temperature. Bound water is described in "Elements of Chemical Engineering" by Badger and McCabe, second edition, published by McGraw-Hill.

There is thus a warm up period at the start of a drying process when the tobacco is being heated and the vapor pressure within the tobacco is increasing without any loss of moisture. In fact if the atmosphere is saturated there will be condensation on the tobacco and an increase in moisture during this period. It appears that the increase in filling power with high humidity drying is due to the enhanced vapor pressure of the moisture within the cellular structure of the tobacco achieved during the warm up period and sustained during the drying period.

During the curing of tobacco moisture is lost, the tobacco withers and its cellular structure collapses. During processing some moisture is returned to the tobacco to assist in the cutting and rolling processes. In the final drying stage under high humidity conditions the application of heat softens the cell wall structure and the pent up vapor pressure tends to restore the original size, which is retained by subsequent hardening of the structure as moisture and temperature are reduced.

Although there is an increase in volume of the tobacco particles which increases the filling power there is also an increase in the beam strength of the particles which further increases the filling power gain.

In practice high temperatures are not desirable with cut lamina because high temperature causes undesirable darkening of the lamina. High temperatures are not so detrimental to the mid rib so maximum gains are obtained with C.R.S. where the expansion and stretching of the particles can result in a lightening of the product color.

The current practice to achieve maximum filling power when drying C.R.S. is to use a rotary dryer preceded by a separate steaming and moistening process. The means used include a screw conveyor, vibrating conveyor or small rotary cylinder. In each case incorporating steam nozzles to heat the tobacco and water sprays to add permanent moisture.

The aim has been to heat the C.R.S. with saturated steam to above 90 degrees C. and as near 100 degrees C. as possible and to increase the moisture content to around 50 percent. The steaming and moistening process produce C.R.S. with the 'pent up' high vapor pressure condition which is then presented to the dryer.

The dryer is generally operating under fairly high humidity conditions because of the high drying load imposed by the added moisture and limited air flow. But this is not necessarily so and in production filling power gains do vary from 20 to 45%.

The object of increasing the moisture content is to increase filling power by restoring the turgor condition of the tobacco. However, this has the undesirable effect of requiring more drying capacity and it has now been found that further increases of tobacco temperature are more beneficial than increases of moisture content and require less drying capacity.

The saturated water vapor pressure for temperatures around boiling point are:

Vapor pressure, bar: 0.5, 0.7, 1.0, Saturated temp., degrees: C. 81, 90, 100.

It is clear that an increase of only 19 degrees C. from 81 degrees C. to 100 degrees C. has doubled the vapor pressure. However, the moisture in the tobacco is largely 'bound' moisture which exerts a vapor pressure less than that of 'free' moisture at the same temperature, so that the tobacco must be heated above 100 degrees C. to achieve the max vapor pressure of 1,0 bar at atmospheric pressure.

The temperature to which the tobacco must be heated depends on its percentage moisture content. For example at 50 percent there is free moisture so the temperature is 100° C., whereas at 35 and 12 percent the temperature is typically 104° C. and 114° C. respectively for cut stem.

The purpose of the preparatory heating process is to raise the tobacco above the 100 degrees C. barrier set by a saturated mixture of steam and air at atmospheric pressure. This may be achieved by heating with superheated steam as described in UK Patent application No. 2 138 666 in which filling power gains in excess of 50% are claimed.

It has been found that the filling power gain is only retained at low moisture and temperatures, both of which conditions tend to harden the tobacco structure. Accordingly it is desirable to maintain the high humidity condition throughout the drying process to prevent any loss of filling power gain.

The maximum humidity can be retained in a rotary dryer by providing a 100 percent steam atmosphere within the drier, and drying without air.

A typical cylinder temperature of a steam heated drier is 160 degrees C. So with a steam atmosphere and a product temperature of near 100 degrees C. the temperature difference is only 60 degrees C. Temperature difference determines the drying capacity, so a high product temperature reduces the drying capacity.

OBJECT OF THE INVENTION

An object of this invention is to combine the preparatory heating process and the drying process into one process which is more economic in use than the previous arrangements. In particular it is an object of the invention to gain the advantage of enhanced filling power obtained by drying in a 100% steam atmosphere, without the disadvantages of product damage and reduced drying capacity due to an elevated product temperature.

SUMMARY OF THE INVENTION

Accordingly the invention provides a rotary dryer for tobacco products comprising a cylinder arranged for rotation about an inclined axis and having means for feeding tobacco into one end of the drying cylinder and means for conveying dried tobacco from the other end of the drying cylinder, heating means arranged to heat the cylinder, a housing arranged to contain the drying cylinder and sealed to be substantially air tight, means for maintaining an atmosphere of super heated steam in the drying cylinders, and means for reducing the pressure in the drying cylinder below atmospheric pressure.

In this manner by providing a drying atmosphere of superheated steam the heat for drying is predominantly transferred from the heated cylinder and the longitudinal heating means which are preferably paddles.

Preferably means is provided in the drying cylinder for superheating steam together with means for injecting steam adjacent the superheating means, means for conveying steam leaving the injection means and one end of the drying cylinder to the superheating means, and ducting for conveying superheated steam from said superheating means to the other end of the cylinder.

With the above arrangement the product temperature corresponds to the saturated temperature of the steam at partial vacuum pressure. The relationship is:

Saturated: C. 100, 90, 80, 70, 60, 50, 40, Pressure bar: 1.0, 0.70, 0.47, 0.31, 0.20, 0.12, 0.7.

The product temperature exceeds this by an amount dependent upon the product moisture content as explained above.

In a further aspect the invention provides a method of drying tobacco products comprising subjecting the tobacco to an atmosphere of superheated steam in a rotary drying chamber, while said atmosphere is maintained at a pressure below atmospheric pressure, typically 0.2 Bar.

These and further and other objects and features of the invention are apparent in the disclosure, which includes the above and ongoing written specification, including the claims and the drawings.

DETAILED DESCRIPTION OF THE PREFERRED EMBODIMENT

Figure 1:
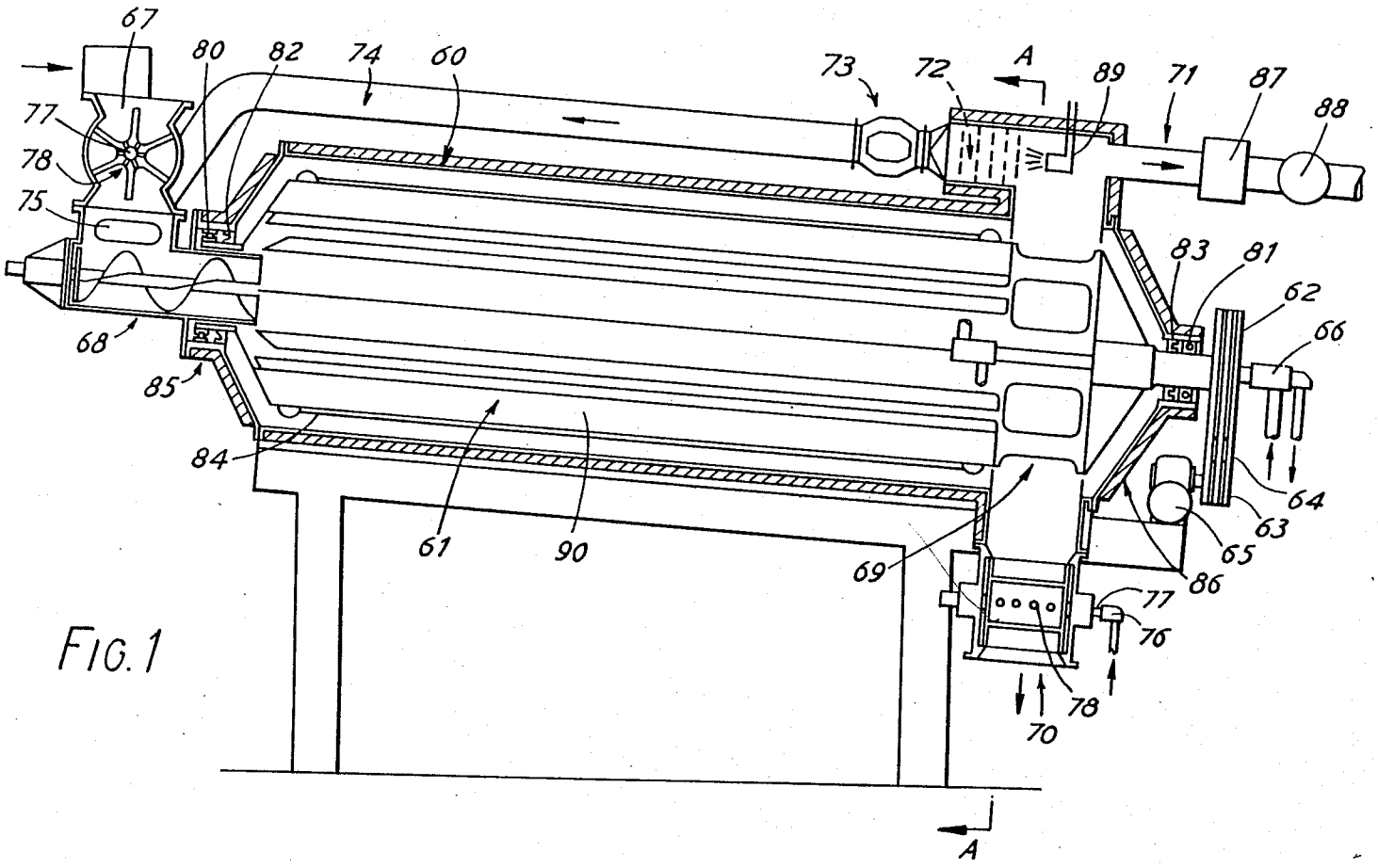
FIG. 1 is a schematic longitudinal section of the drier.
Figure 2:
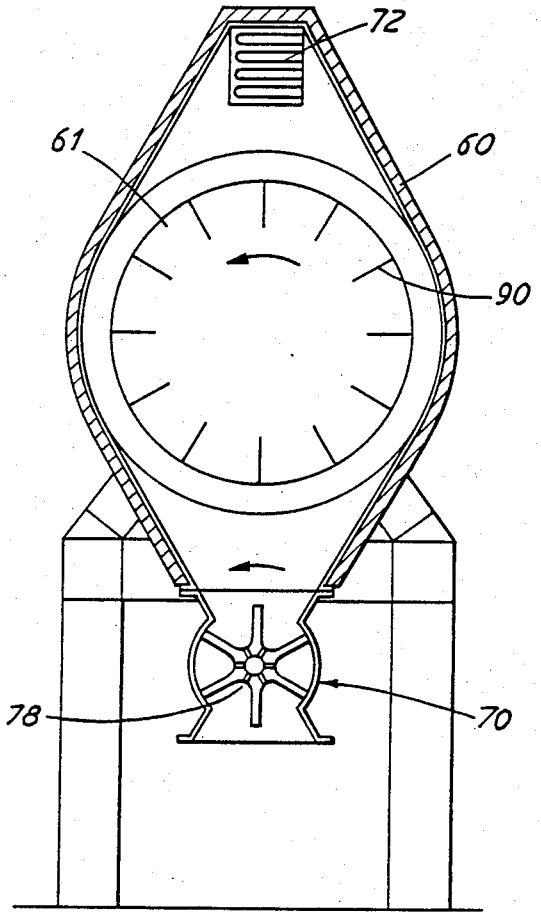
FIG. 2 is a section taken on the line A—A of FIG. 1.

The dryer comprises a sealed vacuum chamber 60 containing a rotary drying cylinder 61 having an internal paddles 90, driven by pulleys 62,63, belts 64 and a motor 65. The cylinder 61 is carried in the housing 60 in bearings 80 and 81 at respective ends of the cylinder and is sealed at those ends to the housing 60 by respective seals 82,83. A rotary steam gland 66 is provided to pass steam into the housing and to a steam jacket formed around the cylinder 61 to heat it, and to pass steam from the jacket out of the housing.

The axis of the drying cylinder is inclined to be horizontal with one end 85, the inlet end, being slightly higher than the other end 86, the exit end.

At the inlet end of the drier there are provided a rotary air lock 67 (cell wheel) of known design per se and a screw conveyor 68 of known design per se, which extends through the end of the housing 60 to carry incoming tobacco products to the interior of the drying cylinder 61. Discharge apertures 69 are provided in the cylinder 61 at the outlet end of the dryer. A further rotary air lock 70 (cell wheel) similar to that shown at 67 is arranged in the wall of the housing 60 beneath the discharge apertures 69.

The tobacco enters and leaves the dryer via the rotary air locks 67, 70. These can be operated with a pressure difference at one bar and have known leak characteristics.

A partial vacuum in the housing 60 is maintained by a condenser shown schematically at 87, of known design per se, and a vacuum pump shown schematically at 88, of known design per se, via an exhaust duct 71 from the housing 60. The condenser can be of the surface or contact type, such as water spray condenser. The pump can be of the ejector or mechanical type, such as a water ring pump. The degree of vacuum achieved will depend on the relationship of pump size to leakage into the housing and of condenser size to drying load.

One or more steam injection nozzles 89 are provided in an upper part of the housing 60 to introduce steam into the housing and thus the drying cylinder 61. Steam from the nozzles 89 and the outlet end of the drying cylinder 61 is drawn through a superheater 72 which is immediately downstream of the nozzles 89, by a recirculation fan 73 and passes via a steam duct 74 to an inlet 75 at the downstream side of the air lock 67, thence into the inlet end of the drying cylinder.

To minimize the leakage of air as opposed to steam into the vacuum chamber 60 each air lock 67, 70 can be filled with steam via a rotary gland shown typically at 76, a hollow shaft 77 for the cell wheel and radial holes 78 in that shaft.

Alternatively double air locks in series may be used at both the inlet and the outlet, with steam at a slightly positive pressure being fed between them.

By these means the atmosphere inside the housing 60 and the drying cylinder 61 is maintained to be substantially only steam and air is excluded.

Adjustment of the pressure within the housing 60 provides a means of adjusting the moisture removal in the dryer, which is faster acting than adjustment of the cylinder temperature, due to the thermal capacity of the latter.

Chamber pressure may be adjusted by controlling the water flow to the condenser 87, which limits its condensing capacity. The condensing water then being heated to near the saturation temperature. This can be achieved automatically by a pressure transducer, controller and modulating water valve (not shown).

To achieve good output moisture control and constant drier conditions and drying load is made constant by feeding constant bone dry weight of tobacco into the dryer and by using a water spray (not shown) at the dryer feed end to maintain a constant water load. The water spray is adjusted by measuring the moisture content of the input tobacco and the bone dry weight is adjusted by variable speed weighing conveyor.

Other advantages and features of the invention will be apparent from the disclosure which includes the above and ongoing specification with the claims and the drawings.

I claim:

1. A rotary dryer for tobacco products comprising:

(a) a cylinder arranged for rotation about an inclined axis;

(b) means for feeding tobacco into one end of the drying cylinder;

(c) means for conveying dried tobacco from the other end of the drying cylinder;

(d) heating means arranged to heat the cylinder;

(e) a housing arranged to contain the drying cylinder and sealed to be substantially airtight;

(f) means for maintaining an atmosphere of superheated steam in the drying cylinder; and (g) means for reducing the pressure in the drying cylinder below atmospheric pressure.

2. A rotary dryer according to claim 1, in which there are provided means in the drying cylinder for superheating steam, means for injecting steam adjacent the superheating means, means for conveying steam leaving the injection means at one end of the drying cylinder to the superheating means, and ducting for conveying superheated steam from said superheating means to the other end of the drying cylinder.

3. A rotary dryer according to claim 1, in which said means for feeding tobacco into the housing and means for conveying dried tobacco from the housing each comprises a respective rotary air lock means.

4. A rotary dryer according to claim 1, in which each said rotary air lock means comprises two rotary air locks arranged in series with means for injecting steam at positive pressure disposed between them.

5. A rotary dryer according to claim 1, in which said means for feedign tobacco into the housing comprises a screw conveyor arranged in the housing to feed tobacco into the interior of the drying cylinder.

6. A rotary dryer according to claim 1, in which said pressure reducing means comprises an exhaust duct leading from the housing, a condensor arranged in the exhaust duct and a vacuum pump arranged to draw steam from the housing through the condensor.

7. A rotary dryer according to claim 1, in which said superheatign means is disposed in a chamber in said housing arranged adjacent the outlet end of the drying cylinder and said conveying means is arranged to drawn steam through the superheater and pass it through said ducting to the inlet end of the drying cylinder.

8. A rotary dryer according to claim 7, in which cooling water flow through the condensor is controlled in response to the steam pressure in the housing in order to maintain the steam pressure in the housing at a chosen value below atmospheric pressure.

9. A rotary dryer according to claim 7, in which steam injecting nozzles are disposed in said chamber immediately upstream of said condensor.

10. A rotary dryer according to claim 3, in which each said rotary air lock means comprises two rotary air locks arranged in series with means for injecting steam at positive pressure disposed between them, said means for feeding tobacco into the housing comprises a screw conveyor arranged in the housing to feed tobacco into the interior of the drying cylinder, and in which said superheating means is disposed in a chamber in said housing arranged adjacent the outlet end of the drying cylinder and said conveying means is arranged to draw steam through the superheater and pass it through said ducting to the inlet end of the drying cylinder, and in which said ducting conveys steam to a point between said inlet air lock and said screw conveyor.

11. A rotary dryer according to claim 1, in which the heating means for the drying cylinder comprises a steam heated jacket around the cylinder.

12. A rotary dryer according to claim 1, in which said drying cylinder is formed with internal paddles to tumble tobacco therein.

13. A rotary dryer according to claim 1, in which the tobacco flow from inlet to outlet means is down the incline of the axis of the drying cylinder while the flow of steam through the cylinder is in the same direction.

14. A method of drying tobacco products comprising subjecting the tobacco to an atmosphere of superheated steam in a rotary drying chamber, while said atmosphere is maintained at a pressure below atmospheric pressure.

* * * * *